US012799836B2

(12) United States Patent
Hu et al.

(10) Patent No.: US 12,799,836 B2
(45) Date of Patent: Nov. 17, 2026

(54) INTELLIGENT WATER DETECTION TOOL FOR HORIZONTAL WELLS

(71) Applicant: SOUTHWEST PETROLEUM UNIVERSITY, Chengdu (CN)

(72) Inventors: Gang Hu, Chengdu (CN); Zongyu Wen, Chengdu (CN); Guorong Wang, Chengdu (CN); Yuhu Xu, Chengdu (CN); Honglin Liao, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 209 days.

(21) Appl. No.: 18/789,724

(22) Filed: Jul. 31, 2024

(65) Prior Publication Data

US 2025/0043644 A1 Feb. 6, 2025

(30) Foreign Application Priority Data

Aug. 1, 2023 (CN) ..... 202310960618.1

(51) Int. Cl.
*E21B 23/00* (2006.01)
*E21B 23/04* (2006.01)
*E21B 47/10* (2012.01)

(52) U.S. Cl.
CPC ..... *E21B 23/001* (2020.05); *E21B 23/04* (2013.01); *E21B 47/10* (2013.01)

(58) Field of Classification Search
CPC ..... E21B 23/001; E21B 23/04; E21B 47/10
See application file for complete search history.

(56) References Cited

U.S. PATENT DOCUMENTS

| | | | | |
|---|---|---|---|---|
| 6,405,798 | B1 * | 6/2002 | Barrett | E21B 23/00 166/250.01 |
| 7,322,416 | B2 * | 1/2008 | Burris, II | E21B 47/04 175/45 |
| 8,981,957 | B2 * | 3/2015 | Gano | G01V 11/00 340/854.3 |
| 9,598,921 | B2 * | 3/2017 | Heijnen | E21B 23/14 |

FOREIGN PATENT DOCUMENTS

| | | | | |
|---|---|---|---|---|
| CN | 101337578 | A | 1/2009 | |
| CN | 110924936 | A | 3/2020 | |
| CN | 116291399 | A | 6/2023 | |
| WO | WO-2020197665 | A1 * | 10/2020 | E21B 41/0035 |

* cited by examiner

*Primary Examiner* — Jill E Culler
(74) *Attorney, Agent, or Firm* — Chieh-Mei Wang

(57) ABSTRACT

This invention discloses an intelligent water detection tool for horizontal wells, including a water detection instrument, and also including a floating-diving component for driving the movement of the water detection instrument, a buoyancy device connected to the water detection instrument, and a buoyancy adjustment component for adjusting the water displacement volume of the buoyancy device. This invention provides an intelligent water detection tool for horizontal wells, using a completely different technical approach to achieve floating-diving style water detection operations in horizontal well sections, aiming to reduce tool friction and facilitate easy passage through horizontal sections.

7 Claims, 9 Drawing Sheets

INTELLIGENT WATER DETECTION TOOL FOR HORIZONTAL WELLS

CROSS-REFERENCE TO RELATED APPLICATION

This application claims the priority under 35 U.S.C. § 119 of Chinese Application No. 202310960618.1, filed Aug. 1, 2023, the entirety of which is incorporated herein by reference.

FIELD OF THE INVENTION

This invention relates to the field of oil and natural gas development, specifically to an intelligent water detection tool for horizontal wells.

BACKGROUND OF THE INVENTION

In petroleum and natural gas engineering, horizontal wells are a common development method for low-permeability oil and gas reservoirs. After being put into production, horizontal wells often experience water production and increasing water cut, which can easily lead to water breakthrough and flooding, greatly affecting the well's productivity. Timely understanding of water production in horizontal wells, quickly locating water entry points or water-producing intervals, and effectively sealing off these points based on this information are important technical means to ensure productivity during horizontal well development.

Traditional water detection techniques such as horizontal well production profile testing, distributed fiber optic production profile testing, dynamic monitoring water detection, and segmented production water detection testing have drawbacks such as low detection accuracy, long downhole operation cycles, low efficiency, and complex tubing string tripping processes. Chinese patent application CN 116291399 A discloses "A gas lift liquid discharge testing and water detection operation system and method for non-flowing oil horizontal wells," which requires a surface gas source for gas lift and relies on coiled tubing operations to work, still facing issues of complex operation processes and low water detection efficiency.

Additionally, existing technology has disclosed the use of downhole crawlers carrying water detection instruments into the well, slowly crawling through the horizontal section for water detection. However, this approach: (1) has high friction during crawling, requiring large power output to meet crawling needs, resulting in complex and bulky downhole string structures; (2) is prone to obstruction during crawling, leading to low operation success rates; (3) can easily cause irreversible damage to the casing wall; (4) has insufficient endurance, limiting the length of the horizontal section that can be inspected in a single run.

In summary, the existing horizontal well water detection technologies still have room for improvement.

BRIEF SUMMARY OF THE INVENTION

The present invention provides an intelligent water detection tool for horizontal wells, using a completely different technical approach from the existing technologies to achieve floating-diving style water detection operations in a horizontal well section, aiming to reduce tool friction and facilitate easy passage through the horizontal well section.

This invention is realized through the following technical solution:

An intelligent water detection tool for horizontal wells, including a water detection instrument, also comprising a floating-diving component for driving the movement of said water detection instrument, a buoyancy device connected to said water detection instrument, and a buoyancy adjustment component for adjusting the water displacement volume of said buoyancy device.

In order to address the issues in existing technologies where horizontal well water detection operations require complex and cumbersome downhole operations, or need downhole crawlers to drag instruments, this application provides for the first time an intelligent water detection tool for horizontal wells. The water detection instrument uses existing instruments in the field and is not limited here. In the present invention, the floating-diving component provides power for the entire water detection tool to move within the well. Those skilled in the art should understand that this movement refers to axial movement along the wellbore trajectory. The buoyancy device provides buoyancy for the entire water detection tool, allowing the water detection tool to float in the horizontal well section after reaching the horizontal well section.

Considering that this tool needs to rely on gravity to reach the horizontal well section during operation, and that well fluid density varies in different well conditions, this application specifically includes a buoyancy adjustment component, so as to ensure that the tool passes through the vertical well section smoothly and floats stably in the horizontal well section. The buoyancy adjustment component is used to adjust the water displacement volume of the buoyancy device, thereby adjusting the buoyancy force experienced by the buoyancy device in the well. This ensures that the water detection tool can smoothly enter the well in a low buoyancy state and flexibly adjust its buoyancy to enter a floating state after reaching the horizontal section, based on specific vertical depth and well fluid density conditions. After entering a floating state, the water detection tool can be driven to move as a whole within the horizontal section by the floating-diving component, thereby completing the horizontal well water detection operation by using the water detection instrument carried thereon.

It can be seen that this application adopts a completely different technical approach from existing technologies, and abandons the traditional operation method of relying on downhole crawlers for towing. It avoids direct contact and friction between the tool and the well wall, eliminating the need for large power equipment, which can significantly reduce the structural complexity of the downhole string and is conducive to the miniaturization of water detection tools. Moreover, since the tool does not directly contact the well wall, it can significantly reduce damage to the downhole pipes from collisions. Additionally, as this application moves in a floating-diving manner, it can more easily pass through obstruction points encountered in traditional operations, such as casing/screen joint locations or deformed sections of casing/screen in the horizontal section. This greatly reduces the risk of obstruction for the water detection instrument, significantly improving operation success rates and downhole safety.

The floating-diving component in this application can adopt any existing underwater floating-diving equipment's movement method to achieve its function, such as using the underwater movement methods of submarines, underwater robots, or torpedoes. It only needs to meet the requirements of working in high-temperature, high-pressure, and two-phase or three-phase mixed flow conditions in the well.

The specific number of buoyancy devices in this application, as well as their specific installation positions within the water detection tool, and the relative positions between each buoyancy device and the water detection instrument are not limited here. In practical operations, these can be adaptively set according to specific application conditions, as long as they meet the requirement of providing controllable buoyancy of the needed magnitude.

Furthermore, the intelligent water detection tool for horizontal wells also includes a shell; the floating-diving component includes propeller blades located inside the shell, a first power source for driving the rotation of said propeller blades, and the area where the propeller blades are located is connected to the outside of the shell.

With propeller blades set inside the shell, driven by the first power source to rotate forward or backward, thrust for forward or backward movement can be provided to the water detection tool, thus stably achieving the floating-diving motion of this application in the horizontal section. The area inside the shell where the propeller blades are located needs to be connected to the outside of the shell, so that after this tool enters the well, well fluids can enter the area where the propeller blades are located inside the shell, providing the necessary thrust when the blades rotate, enabling the floating-diving motion of this application to utilize well fluids. Additionally, the driving of the propeller blades by the first power source can be achieved through any existing drive and transmission methods, as long as they meet the requirements for forward and reverse rotation of the blades.

Furthermore, the buoyancy device includes a bag located inside the shell, the area where the bag is located is connected to the outside of the shell, and the bag is filled with hydraulic oil.

The buoyancy device in this solution includes a bag filled with hydraulic oil, located inside the shell to reduce the risk of being punctured downhole; the area inside the shell where the bag is located needs to be connected to the outside of the shell, so that after this tool enters the well, well fluids can enter the area where the bag is located inside the shell, providing the necessary buoyancy for the bag, allowing the tool as a whole to be in a suspended state through the bag's buoyancy. In this solution, the buoyancy adjustment component only needs to adjust the volume of hydraulic oil entering the bag to change the expansion size of the bag, thereby achieving adjustment of the bag's water displacement and buoyancy.

Furthermore, the buoyancy adjustment component includes an oil cylinder connected to the bag, a piston located inside the oil cylinder, and a second power source for driving the piston to move within the oil cylinder.

In this solution, by controlling the position of the piston inside the oil cylinder with the second power source, the amount of hydraulic oil entering the bag can be adjusted, thereby changing the expansion size of the bag to alter its volume. The bag is preferably made of materials with good toughness and strong deformation capabilities.

Furthermore, the buoyancy adjustment component also includes a sensing ring installed on the surface of the shell, multiple first sensors evenly distributed on the sensing ring, and a control module signal-connected to the first sensors; the first sensors are used to sense the well wall, and the control module is used to control the second power source.

This solution uses multiple first sensors to sense the well wall in different circumferential directions. The sensing method of the first sensors for the well wall can adopt indirect sensing methods such as infrared, laser, or ultrasonic distance measurements, or direct sensing methods such as contact sensing or pressure sensing to monitor whether the well wall has been contacted.

When the upper first sensors detect that they are too close to or have already contacted the well wall, it indicates that the buoyancy of the water detection tool is too high. At this time, the control module can control the second power source to appropriately reduce the oil volume in the bag. Conversely, when the lower first sensors detect that they are too close to or have already contacted the well wall, it indicates that the buoyancy of the water detection tool is too low. At this time, the control module can control the second power source to appropriately increase the oil volume in the bag. Therefore, this solution helps ensure the vertical centering of the water detection tool during floating-diving in the well, further reducing the risk of obstruction.

Furthermore, it includes a second sensor for sensing the circumferential posture of the intelligent water detection tool for horizontal wells, with the second sensor signal-connected to the control module.

During the research process, the inventors of this application found that although the water detection tool moves in the well by floating-diving, its circumferential posture during movement cannot remain unchanged. Affected by specific wellbore structures and different completion methods, the water detection tool may rotate during floating-diving in the well, manifesting as changes in the tool's circumferential posture. Once the tool rotates, it becomes difficult for the control module to distinguish which first sensors are on top and which are on the bottom, making it impossible to effectively control the tool's vertical centering. To overcome this problem, this solution also sets up a second sensor to sense the circumferential posture of the water detection tool, allowing the control module to track the tool's rotational changes in real-time, make real-time corrections to the tool's vertical direction, and use this as a basis to judge the sensing signals of each first sensor, ensuring effective control of the tool's vertical centering. Here, the circumferential posture of the water detection tool refers to the state of the tool's overall circumferential rotation in the well, i.e., which end is facing up and which end is facing down.

The sensing and judgment of the tool's circumferential posture by the second sensor can adopt any existing sensing method that can be implemented by those skilled in the art. Preferably, the sensing and judgment of the tool's circumferential posture by the second sensor can be achieved based on stable external environmental indicators, such as sensing the direction of gravity or the direction of the geomagnetic field.

Furthermore, it includes an anchoring sub that is coaxial with the shell and can be detachably connected, and a third power source for driving the anchoring sub to anchor in the well; the anchoring sub has a cable connection head.

This solution connects the anchoring sub between the shell and the cable, with the cable connection head used to connect the cable, thus facilitating the lowering of the water detection tool into the well using cable operations. During the lowering process, the anchoring sub remains connected to the water detection tool. After the tool reaches the horizontal section, the third power source drives the anchoring sub to activate and anchor itself in the well. Then, the shell separates from the anchoring sub, and the floating-diving component drives the shell to float-dive in the horizontal section for water detection operations, while the anchoring sub remains in its current position. After the water detection operation is completed, the shell is reconnected with the anchoring sub, and the cable is retrieved at the wellhead, thus completing the recovery of the water detection tool.

The detachable connection method between the anchoring sub and the shell is not limited here; any existing detachable connection methods in the field that can achieve downhole docking and separation are applicable. Additionally, the specific anchoring method of the anchoring sub is also not limited here; common temporary downhole anchoring structures in the field such as slips, hangers, or packers are all applicable.

Furthermore, it includes a first docking part set on the anchoring sub, a second docking part connected to the shell, a coupling mechanism for engaging and disengaging the first docking part and the second docking part, and an orientation mechanism for rotating the first docking part.

In this solution, the detachable connection between the anchoring sub and the shell is achieved through the coupling mechanism connecting the first docking part and the second docking part. Specifically, during the well entry process, the coupling mechanism maintains an effective connection between the first docking part and the second docking part, allowing the anchoring sub and shell to enter the well together. When the water detection tool reaches the horizontal section and the anchoring sub completes anchoring, the coupling mechanism activates, separating the first docking part from the second docking part for subsequent water detection operations. After the water detection operation is completed, the floating-diving component drives the shell back to a position near the anchoring sub, and the coupling mechanism is reactivated to re-engage the first docking part with the second docking part.

Similarly, considering that the water detection tool may rotate during the floating-diving process in the well, this solution specifically includes an orientation mechanism for rotating the first docking part. Before re-engaging the first docking part with the second docking part, the orientation mechanism can be used to rotate the first docking part, adjusting the relative circumferential position of the first docking part to the second docking part, placing them in a position favorable for docking, thereby significantly increasing the success rate of docking.

The coupling mechanism in this solution can be implemented using any existing coupling technology, as long as it connects the first docking part and the second docking part when docking is needed, and separates them when disengagement is required. Examples include clutch structures from automotive transmissions, spacecraft docking and separation structures, or direct use of electromagnetic clutches. Additionally, this coupling mechanism can be implemented using existing downhole docking methods in the field, such as electromagnetically controlled strong magnetic docking and separation methods, fishing jar methods, or mechanical grappling methods.

Furthermore, it includes a battery set inside the shell, a wireless charging transmitter module set on the first docking part, and a wireless charging receiver module set on the second docking part; the wireless charging receiver module is electrically connected to the battery; when the first docking part and the second docking part are docked, the wireless charging transmitter module and wireless charging receiver module are electrically connected.

The battery inside the shell can be used to power various electrical devices within the shell. This solution sets up a wireless charging transmitter module on the first docking part and a wireless charging receiver module on the second docking part, enabling battery charging to overcome the limitation of insufficient endurance in existing technologies. Specifically, during the well entry process of this application's water detection tool, since it is lowered by cable, power can be directly supplied by the cable, allowing the battery to be charged during the well entry process. This overcomes the limitation of needing to fully charge the tool at the wellhead before lowering, significantly saving operation time. Additionally, if the battery power is insufficient during the water detection process, the floating-diving component can drive the shell back to the anchoring sub's position to re-dock, completing battery charging downhole without needing to retrieve the tool. This eliminates the need for tripping the string during the water detection process, significantly improving water detection operation efficiency and ensuring that the entire horizontal section can be inspected in a single well entry.

Furthermore, it includes a third sensor set on either the first docking part or the second docking part; the third sensor is used to obtain the distance and/or posture of the second docking part or the first docking part when the first docking part and the second docking part are docking.

This solution uses the third sensor for positioning judgment during the docking of the first docking part and the second docking part, determining whether the relative distance and orientation between the first docking part and the second docking part meet docking conditions. If docking conditions are not met, the floating-diving component can adjust the relative distance, and the orientation mechanism can adjust the relative orientation. Once docking conditions are met, the coupling mechanism is activated for docking.

When the third sensor is set on the first docking part, it is used to obtain the distance and/or posture of the second docking part; when set on the second docking part, it obtains the distance and/or posture of the first docking part. In this solution, posture refers to the circumferential state of the first docking part or second docking part in the well, i.e., which end is facing up and which is facing down.

The specific sensing method of the third sensor can be implemented using existing distance and/or posture sensing technologies, such as infrared sensing, laser sensing, radar sensing, radio frequency identification, or image recognition.

Compared with the prior art, the present invention has the following advantages and beneficial effects:

1. This intelligent water detection tool for horizontal wells adopts a completely different technical approach from existing technologies, abandoning the traditional operation method of relying on downhole crawlers for towing. It avoids direct contact and friction between the tool and the well wall, eliminating the need for large power equipment, which can significantly reduce the structural complexity of the downhole string and is conducive to the miniaturization of water detection tools. It also significantly reduces damage to downhole pipes from collisions.
2. This intelligent water detection tool for horizontal wells moves in a floating-diving manner in the horizontal section, making it easier to pass through obstruction points encountered in traditional water detection operations, greatly reducing the risk of obstruction for the water detection instrument, and significantly improving operation success rates and downhole safety.
3. This intelligent water detection tool for horizontal wells can provide forward or backward thrust for the water detection tool by controlling the forward or reverse rotation of the propeller blades, stably achieving floating-diving in the horizontal section.

4. This intelligent water detection tool for horizontal wells flexibly adjusts buoyancy magnitude through the buoyancy adjustment component, ensuring the tool can stably enter the well and reach the horizontal section, while maintaining good longitudinal centering during floating-diving in the horizontal section.
5. This intelligent water detection tool for horizontal wells ensures stable and reliable lowering into and retrieval from the well through the anchoring sub.
6. This intelligent water detection tool for horizontal wells improves the success rate of docking in the well through the orientation mechanism.
7. This intelligent water detection tool for horizontal wells can achieve automatic charging in the well, eliminating the need for tripping the string for charging during the water detection process, significantly improving water detection operation efficiency, and ensuring that the entire horizontal section can be inspected in a single well entry.

BRIEF DESCRIPTION OF THE DRAWINGS

The drawings described here are used to provide further understanding of the embodiments of this invention, forming part of this application, and do not constitute limitations on the embodiments of this invention. In the drawings.

DETAILED DESCRIPTION OF THE PREFERRED EMBODIMENTS

To make the purpose, technical solution, and advantages of this invention clearer and more understandable, the following provides a more detailed description of this invention in combination with embodiments and drawings. The illustrative embodiments and their descriptions are only used to explain this invention and should not be construed as limitations on this invention.

Embodiment 1

Figure 1:
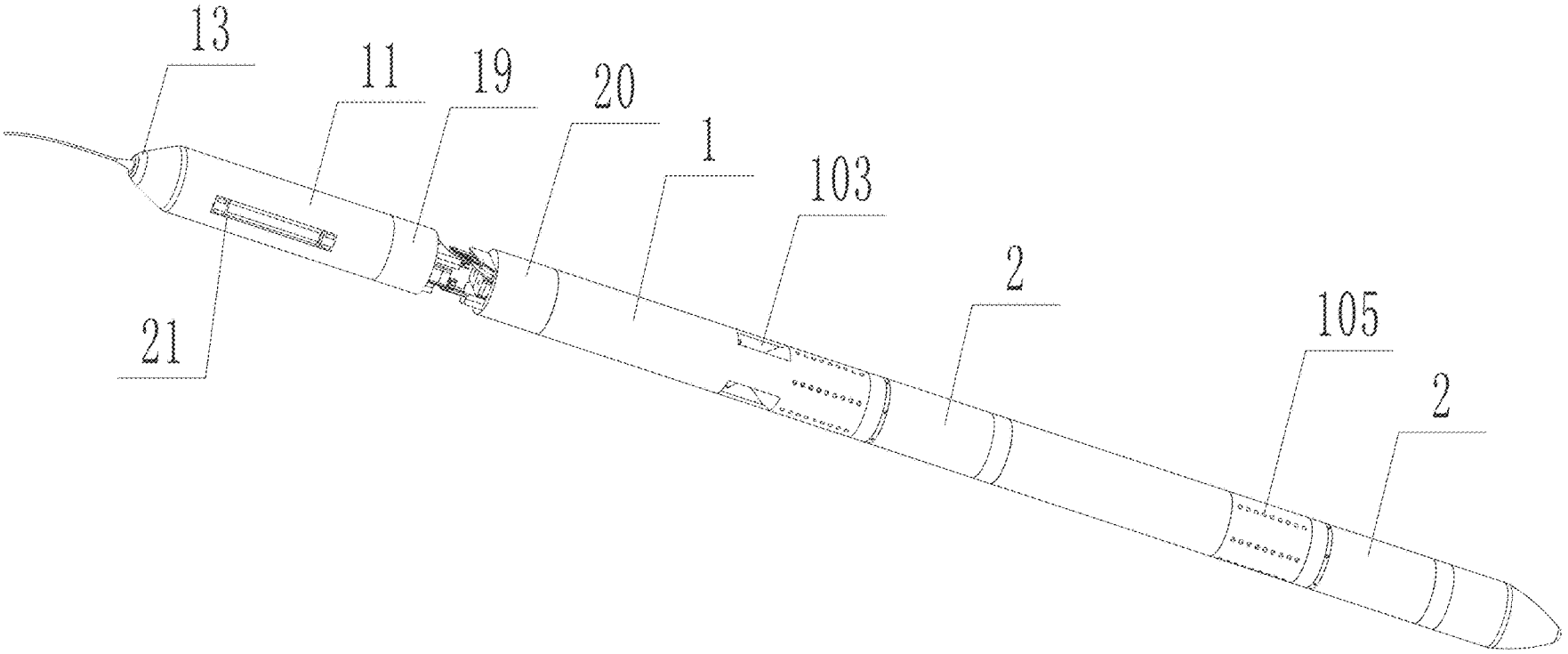
FIG. 1 is a structural schematic diagram of a specific embodiment of this invention.
Figure 2:
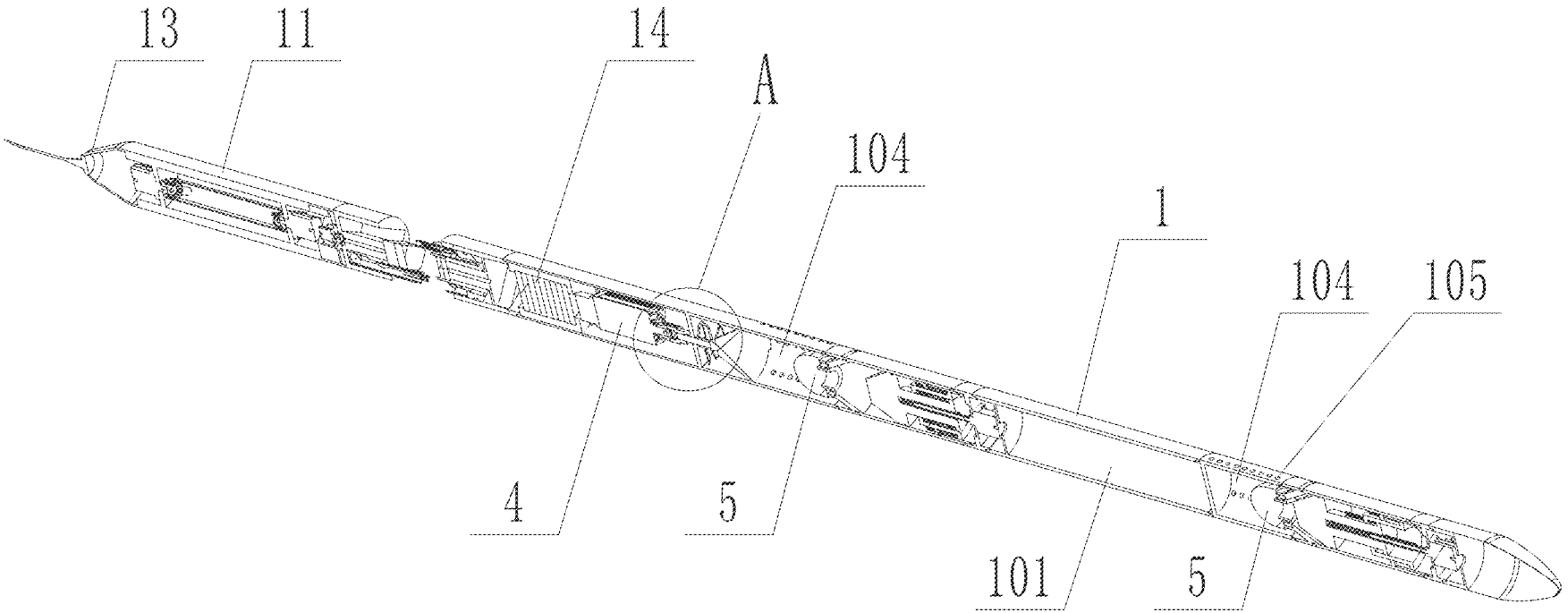
FIG. 2 is a half-sectional schematic diagram of a specific embodiment of this invention.
Figure 3:
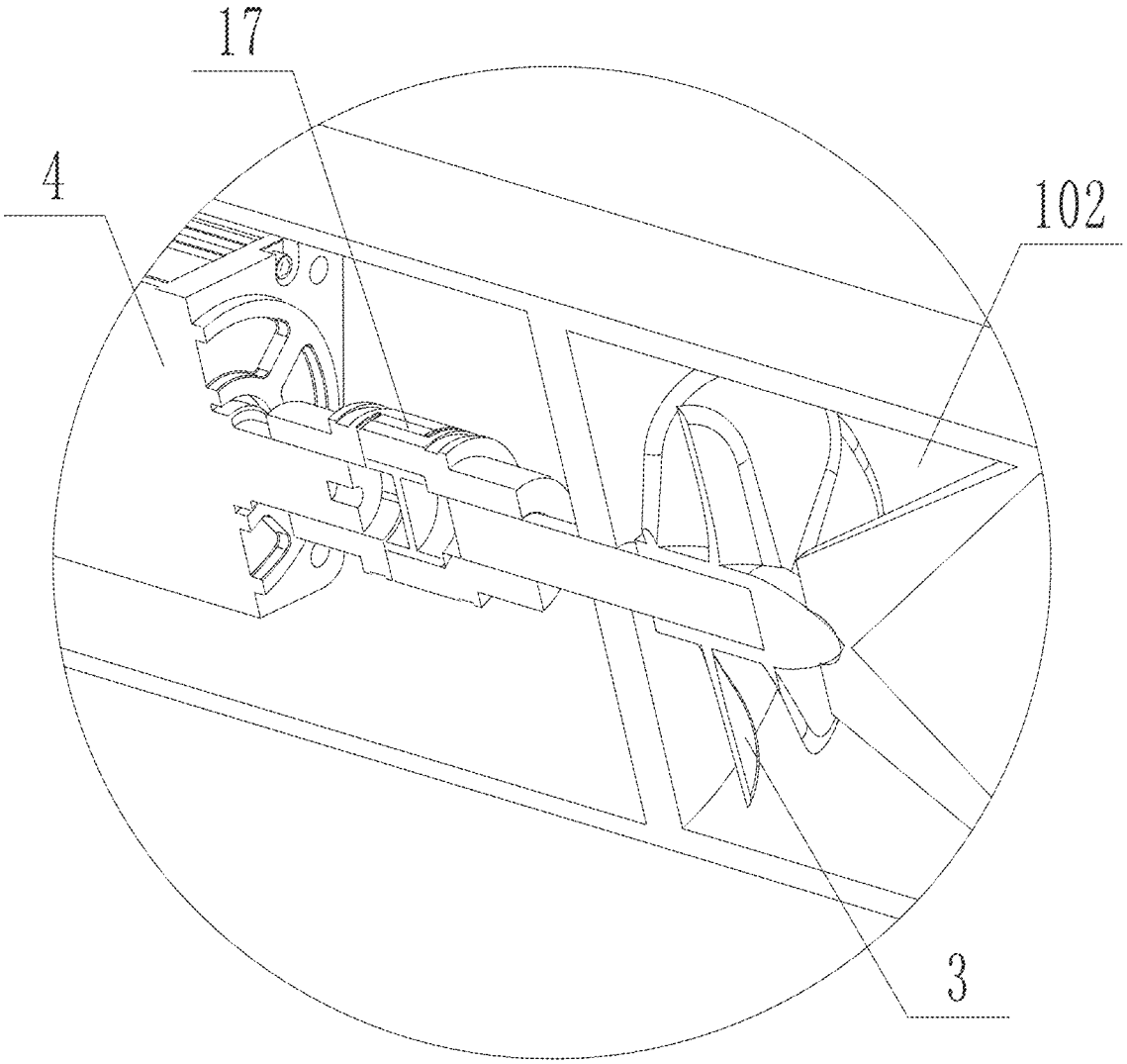
FIG. 3 is an enlarged partial view of area A in FIG. 2.

As shown in FIGS. 1 to 3, an intelligent water detection tool for horizontal wells includes a shell 1, a water detection instrument installed inside the shell 1, a floating-diving component for driving the movement of the water detection instrument, a buoyancy device 2 connected to the water detection instrument, and a buoyancy adjustment component for adjusting the buoyancy magnitude of the buoyancy device 2. The floating-diving component includes propeller blades 3 located inside the shell 1, a first power source 4 for driving the rotation of the propeller blades 3, and the area where the propeller blades 3 are located is connected to the outside of the shell 1. The buoyancy adjustment component adjusts the buoyancy by changing the volume of the buoyancy device 2.

In this embodiment, the propeller blades 3 are a screw propeller, and the first power source 4 is an electric motor, with the output end of the motor connected to the screw propeller through a coupling 17.

As shown in FIGS. 1 to 3, this embodiment sets up a first chamber 101 and a second chamber 102 inside the shell 1; the first chamber 101 is used to install the water detection instrument, the propeller blades 3 are located in the second chamber 102, and several circumferentially distributed openings 103 are made on the surface of the shell 1 to connect the inside and outside of the second chamber 102.

In this embodiment, a buoyancy device 2 is set at each end of the water detection instrument, and each buoyancy device 2 is equipped with a buoyancy adjustment component, which is conducive to controlling the overall posture of the water detection tool. Moreover, since the horizontal section of horizontal wells is rarely completely horizontal in engineering practice, with the well inclination generally fluctuating within the range of 90°±5°, this embodiment can match the posture of the water detection tool with the well inclination of the horizontal section through independent control of at least two buoyancy devices 2 at the front and rear, thereby further facilitating the stable floating-diving of the water detection tool in the well.

Additionally, the shell 1 in this embodiment can be a one-piece structure, or it can adopt a multi-segment split or detachable connection structure according to different subdivision situations of the water detection tool.

The working process of this embodiment includes:

Lowering the water detection tool to the horizontal section; during the lowering process, adjusting the water displacement volume of the buoyancy device 2 through the buoyancy adjustment component to make the buoyancy experienced by the water detection tool less than its weight;

After reaching the desired position, increasing the water displacement volume of the buoyancy device 2 through the buoyancy adjustment component to provide sufficient buoyancy for the water detection tool until it is suspended in the well fluids of the horizontal section;

Driving the propeller blades 3 to rotate forward, causing the water detection tool to float-dive and advance in the horizontal section, with the water detection instrument performing water detection during the advancement;

After the water detection operation is completed, driving the propeller blades 3 to rotate in reverse to retrieve the water detection tool.

Embodiment 2

Figure 4:
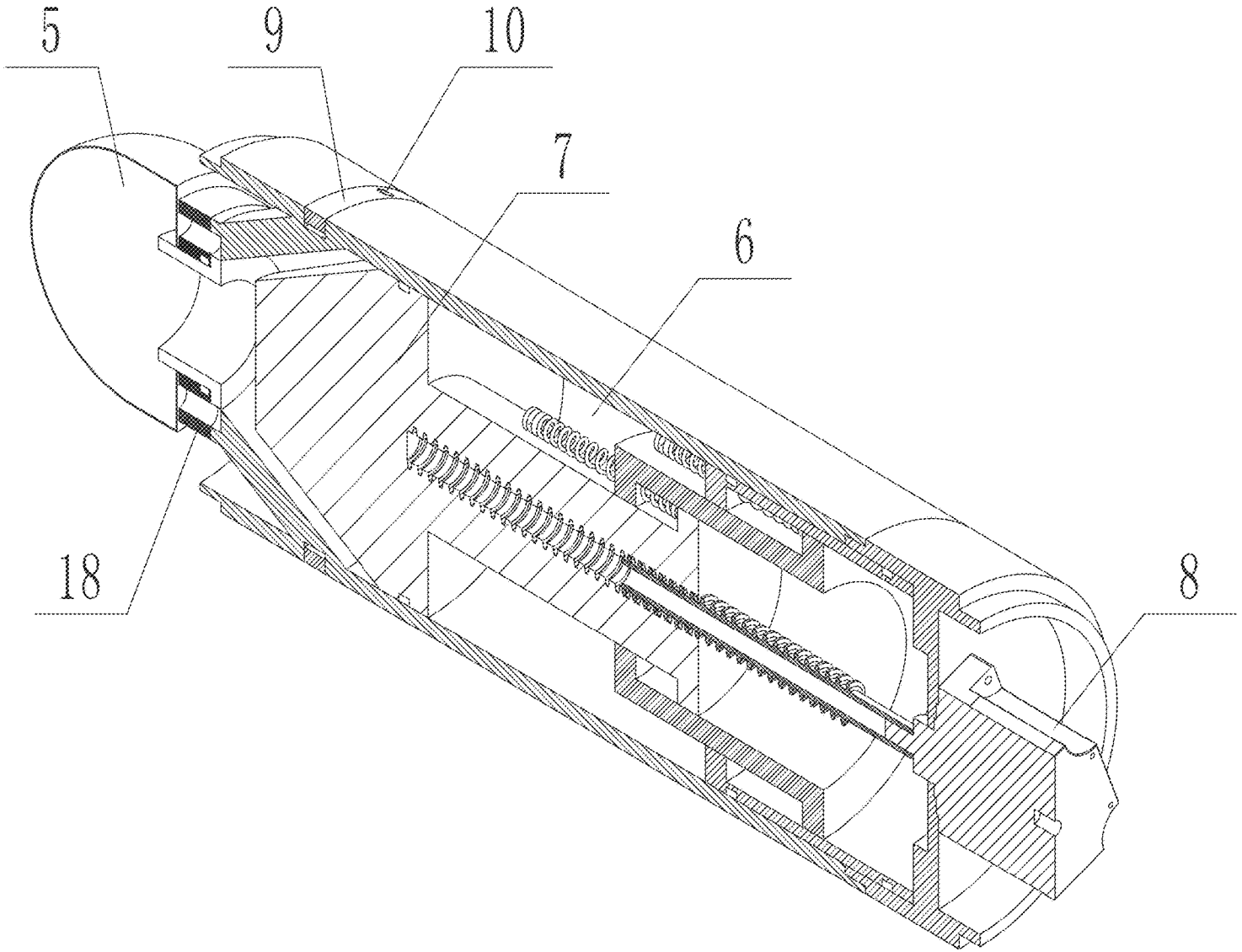
FIG. 4 is a half-sectional schematic diagram of the buoyancy adjustment component in a specific embodiment of this invention.

An intelligent water detection tool for horizontal wells, based on Embodiment 1, as shown in FIGS. 2 and 4, the buoyancy device 2 includes a bag 5 located inside the shell 1, the area where the bag 5 is located is connected to the outside of the shell 1, and the bag 5 is filled with hydraulic oil.

The buoyancy adjustment component includes an oil cylinder 6 connected to the bag 5, a piston 7 located inside the oil cylinder 6, and a second power source 8 for driving the piston 7 to move within the oil cylinder 6.

The buoyancy adjustment component also includes a sensing ring 9 installed on the surface of the shell 1, multiple first sensors 10 evenly distributed on the sensing ring 9, and a control module signal-connected to the first sensors 10; the first sensors 10 are used to sense the well wall, and the control module is used to control the second power source 8.

In this embodiment, the bag 5 is made of materials with good deformation capabilities; preferably, a rubber oil bag is used, which is installed and positioned by a bag seat 18 fixed inside the shell 1.

In this embodiment, a third chamber 104 is set inside the shell 1, with the third chamber 104 corresponding one-to-one with the bag 5, each bag 5 is located in its corresponding third chamber 104; at least one sensing ring 9 is installed on the outside of each third chamber 104. Several through holes 105 are made on the surface of the shell 1 to connect the inside and outside of the third chamber 104.

In this embodiment, the second power source 8 uses a linear actuator or linear motor to drive the piston 7 in linear reciprocating motion; the first sensors 10 are preferably distance sensors.

It also includes a second sensor for sensing the circumferential posture of the intelligent water detection tool for horizontal wells, with the second sensor signal-connected to the control module. The second sensor preferably uses a gravity acceleration sensor to obtain the circumferential posture of the water detection tool by sensing the direction of gravity. The second sensor can be fixedly installed at any position inside or outside the shell.

When the water detection tool is floating-diving and advancing in the horizontal section for water detection operations, it continuously monitors the vertical centering at the position of each sensing ring 9:

- If the position of a certain sensing ring 9 is vertically too high, release part of the fluid filled in the corresponding bag to make it shrink and reduce its water displacement until the position of that bag is vertically centered;
- If the position of a certain sensing ring 9 is vertically too low, continue to fill fluid into the corresponding bag, causing it to expand and increase its water displacement until the position of that bag is vertically centered.

This embodiment determines vertical centering through the following method:

- Obtain the distances between each first sensor 10 on the sensing ring 9 and the wall of the horizontal section of the well wall;
- Assess the dispersion degree of all distances on that sensing ring 9;
- If the dispersion degree is greater than a set threshold, specifically determine which one or more first sensors 10 are too close to the well wall;
- Then obtain the sensing signal from the second sensor to determine whether the first sensors 10 that are too close to the well wall are in a vertically higher or lower position.

In a more preferred embodiment, a guide head is set at the bottom of the water detection tool, with the control module installed inside the guide head; the control module can use controllers such as PLCs.

In a more preferred embodiment, the piston 7 can use a multi-stage cylinder sleeve configuration to increase the adjustment capability of the bag 5 volume while avoiding excessive length of the buoyancy adjustment component; as shown in the three-stage cylinder sleeve structure in FIG. 4, springs are also set between adjacent cylinder sleeve stages to assist in bag reset.

Embodiment 3

An intelligent water detection tool for horizontal wells, based on Embodiment 1 or 2, as shown in FIGS. 1 to 6, also includes an anchoring sub 11 that is coaxial with and detachably connected to the shell 1, and a third power source 12 for driving the anchoring sub 11 to anchor in the well; the anchoring sub 11 has a cable connection head 13.

In this embodiment, the detachable connection between the shell 1 and the anchoring sub 11 is achieved through a first docking part 19 and a second docking part 20: the first docking part 19 is set at the bottom end of the anchoring sub 11, and the second docking part 20 is set at the top end of the shell 1; here, the bottom end and top end refer to the direction towards the bottom of the well and towards the wellhead, respectively, when the tool is in the well. It also includes a coupling mechanism for engaging and disengaging the first docking part 19 and the second docking part 20, and an orientation mechanism for rotating the first docking part 19.

The first docking part 19 is rotatably connected to the anchoring sub 11 to ensure that when the first docking part rotates relative to the second docking part, it does not affect the stable anchoring of the anchoring sub.

It also includes a battery 14 set inside the shell 1, a wireless charging transmitter module 15 set on the first docking part, and a wireless charging receiver module 16 set on the second docking part; the wireless charging receiver module 16 is electrically connected to the battery 14; when the first docking part and the second docking part are docked, the wireless charging transmitter module 15 and wireless charging receiver module 16 are electrically connected. This battery is used to power various electrical devices inside the shell, and when the first docking part and second docking part are docked, the battery can be charged through the cable.

Figure 5:
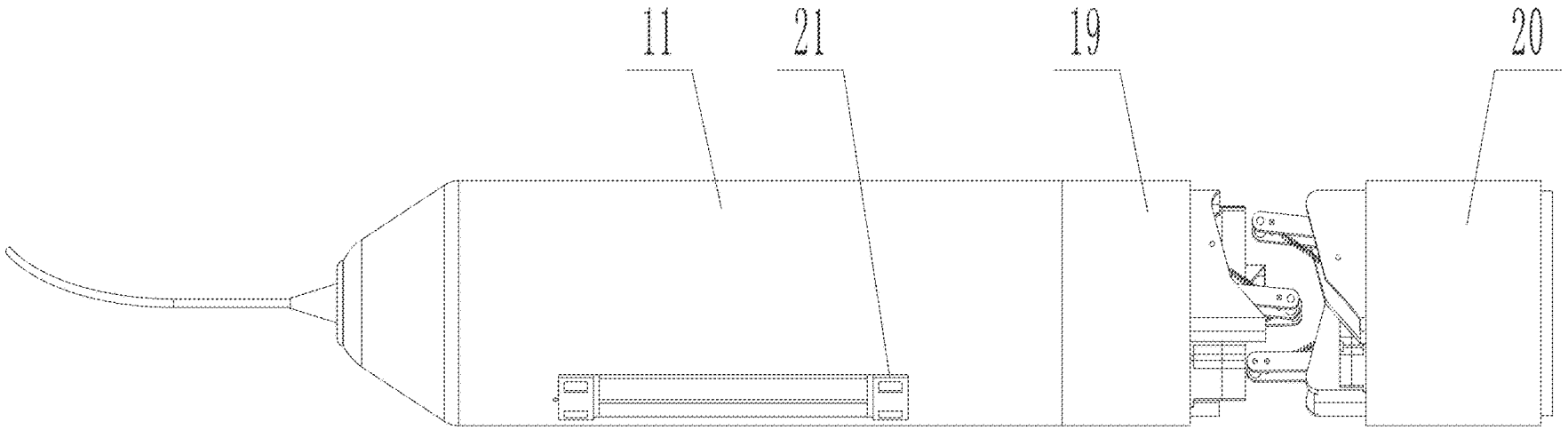
FIG. 5 is a partial structural schematic diagram of the anchoring sub in a specific embodiment of this invention.
Figure 6:
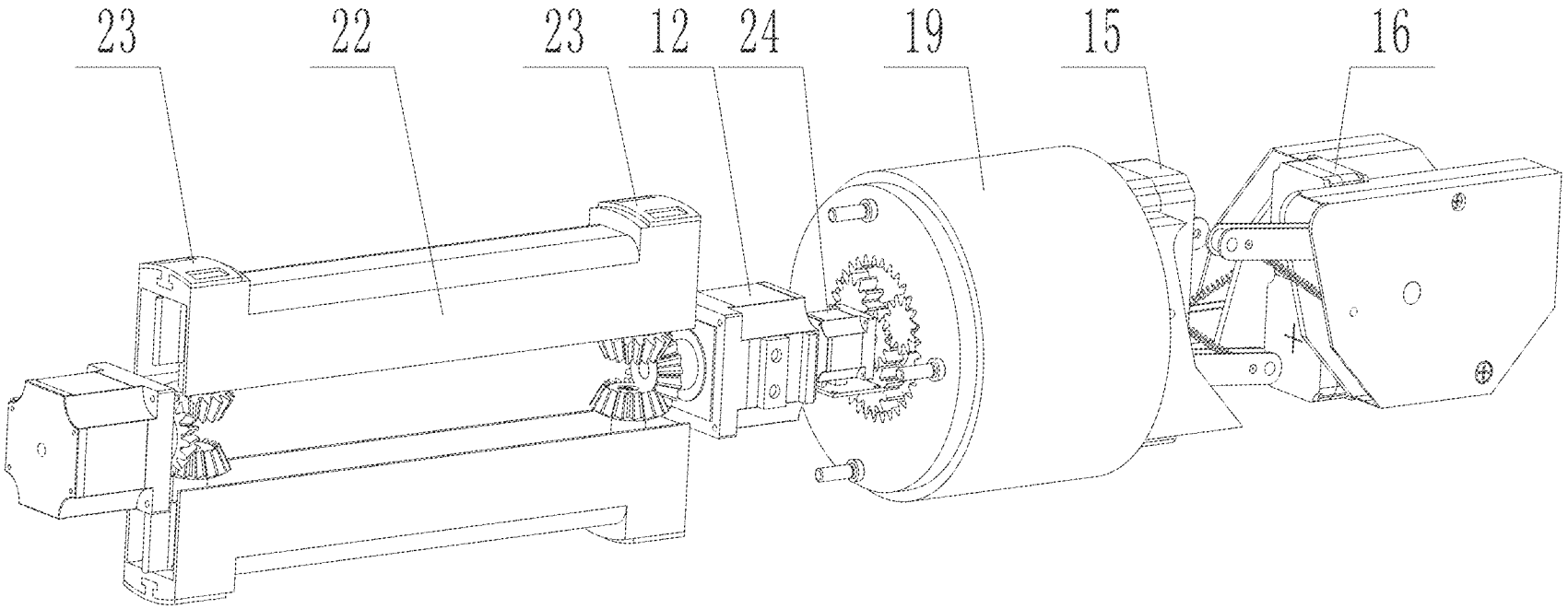
FIG. 6 is an internal schematic diagram of the anchoring sub in a specific embodiment of this invention.

As shown in FIGS. 5 and 6, the anchoring sub 11 in this embodiment includes an outer casing, a positioning frame 22 located inside the outer casing, anchoring blocks 23 radially movably mounted inside the positioning frame 22, and notches 21 on the outer casing corresponding one-to-one with each anchoring block 23. When anchoring is not needed, each anchoring block 23 retracts inward into the outer casing; when anchoring is needed, the third power source 12 drives each anchoring block 23 to move radially outward until they firmly abut against the well wall such as casing/tubing/screen in the horizontal section.

In this embodiment, the anchoring blocks 23 are rubber blocks with rough outer surfaces; the third power source 12 in this embodiment is an electric motor, with its output end achieving radial drive of each anchoring block 23 through a transmission mechanism.

Preferably, the above transmission mechanism is composed of bevel gears and/or lead screws.

As shown in FIG. 6, the orientation mechanism in this embodiment includes a fourth power source 24, preferably using an electric motor, with its output end connected to the first docking part 19 through a gear set to drive the rotation of the first docking part 19.

This embodiment also includes a third sensor set on the first docking part; the third sensor is used to obtain the distance and posture of the second docking part when the first docking part and the second docking part are docking.

Preferably, the third sensor uses a laser radar sensor or ultrasonic sensor, which obtains the distance and posture of the second docking part by determining the distance and circumferential position of the point on the second docking part closest to the first docking part.

The coupling mechanism in this embodiment can be implemented using existing coupling technologies, such as clutch structures from automotive transmissions, spacecraft docking and separation structures, electromagnetic clutches, electromagnetically controlled strong magnetic coupling and separation, downhole fishing jar and fishing tool combinations, or mechanical grappling and release methods.

The method for lowering the water detection tool to the horizontal section in this embodiment specifically includes:

Docking the anchoring sub to the top end of the water detection tool at the wellhead;

Connecting the cable to the anchoring sub;

Releasing the cable and lowering the water detection tool to the predetermined depth;

Anchoring the anchoring sub at the current position;

Separating the water detection tool from the anchoring sub.

During the process of releasing the cable in this embodiment, the battery is charged through the cable; during the floating-diving process of the water detection tool in the horizontal section, when the battery power is lower than a set threshold, the water detection tool is made to float-dive back to the anchoring sub's position, re-dock with the anchoring sub through the coupling mechanism, and then charge the battery through the cable.

Preferably, after the water detection tool is lowered to the predetermined depth in the horizontal section, first determine if the battery is fully charged: if not yet fully charged, maintain the docking of the water detection tool with the anchoring sub until the battery is fully charged, then separate the water detection tool from the anchoring sub.

Additionally, during the floating-diving process, use the following method to determine if the battery power is below the set threshold:

The water detection tool continuously records the distance traveled forward after separating from the anchoring sub, and calculates the minimum power required to return this distance after shutting off the water detection instrument;

Continuously monitor the remaining battery power and determine:

If the remaining power $<\alpha\times$ the aforementioned minimum power, it is determined that the battery power is below the set threshold, at which point the water detection instrument should be immediately shut off and the water detection tool should return to the anchoring sub for charging; where $\alpha$ is a coefficient greater than 1;

After charging is complete, keep the water detection instrument off, make the water detection tool float-dive back to the position of the last return, then restart the water detection instrument and continue the water detection operation.

Furthermore, after the water detection operation is completed in this embodiment, make the water detection tool float-dive back to the anchoring sub's position, re-dock with the anchoring sub through the coupling mechanism, and then the tool can be retrieved from the well using the cable.

Embodiment 4

An intelligent water detection tool for horizontal wells, based on Embodiment 3, this embodiment designs a coupling mechanism specifically for this application, which can achieve rapid disengagement and stable docking of the first docking part 19 and the second docking part 20. Specifically:

As shown in FIGS. 6 to 9, the coupling mechanism in this embodiment includes a first mounting plate 25 located inside the first docking part 19 and a second mounting plate 26 located inside the second docking part 20;

It also includes a fifth power source 27 fixedly installed on the first mounting plate 25, a first positioning wheel 29 rotatably connected to the first mounting plate through a first shaft 28, a first engaging member 30 hinged on the first positioning wheel 29, a first engaging slot 37 opened on the outer diameter end of the first positioning wheel 29, and a first elastic member 31 connected between the first engaging member 30 and the first mounting plate 25; the fifth power source 27 is used to drive the first positioning wheel 29 to rotate around the first shaft 28;

It also includes a sixth power source 32 fixedly installed on the second mounting plate 26, a second positioning wheel 34 rotatably connected to the second mounting plate through a second shaft 33, a second engaging member 35 hinged on the second positioning wheel 34, a second engaging slot 38 opened on the outer diameter end of the second positioning wheel 34, and a second elastic member 36 connected between the second engaging member 35 and the second mounting plate 26; the sixth power source 32 is used to drive the second positioning wheel 34 to rotate around the second shaft 33.

When this embodiment is in operation, the first docking part 19 and the second docking part 20 enter the well in a mutually docked state. At this time, as shown in FIG. 9, the fifth power source 27 and the sixth power source 32 are in their initial states, the first engaging member 30 is engaged in the second engaging slot 38, and the second engaging member 35 is engaged in the first engaging slot 37, with the first engaging slot 37 and the second engaging slot 38 located on opposite sides of the line connecting the first shaft 28 and the second shaft 33; in this state, since neither the first positioning wheel 29 nor the second positioning wheel 34 can rotate, the entire coupling mechanism can maintain a very stable connection state, ensuring stable mutual docking of the first docking part 19 and the second docking part 20.

When it is necessary to separate the first docking part 19 and the second docking part 20 through the coupling mechanism of this embodiment, the fifth power source 27 and the sixth power source 32 are activated, causing the first positioning wheel 29 to rotate, driving the first engaging member 30 to rotate in the direction of disengaging from the second engaging slot 38, while simultaneously causing the second positioning wheel 34 to rotate, driving the second engaging member 35 to rotate in the direction of disengaging from the first engaging slot 37, until the first engaging member 30 completely disengages from the constraint of the second engaging slot 38 and the second engaging member 35 completely disengages from the constraint of the first engaging slot 37. At this point, the coupling mechanism is in the state shown in FIGS. 7 and 8, completing the mutual separation of the first docking part 19 and the second docking part 20.

Preferably, before docking using the coupling mechanism of this embodiment, first adjust the water detection tool to a centered state using the buoyancy adjustment component, then obtain the distance of the second docking part using the third sensor and control the floating-diving component to fine-tune this distance. After the distance meets the docking conditions, obtain the posture of the second docking part, and then use the fourth power source 24 to rotate the first docking part 19 to a state that matches the posture of the second docking part 20 and is conducive to docking.

Figure 7:
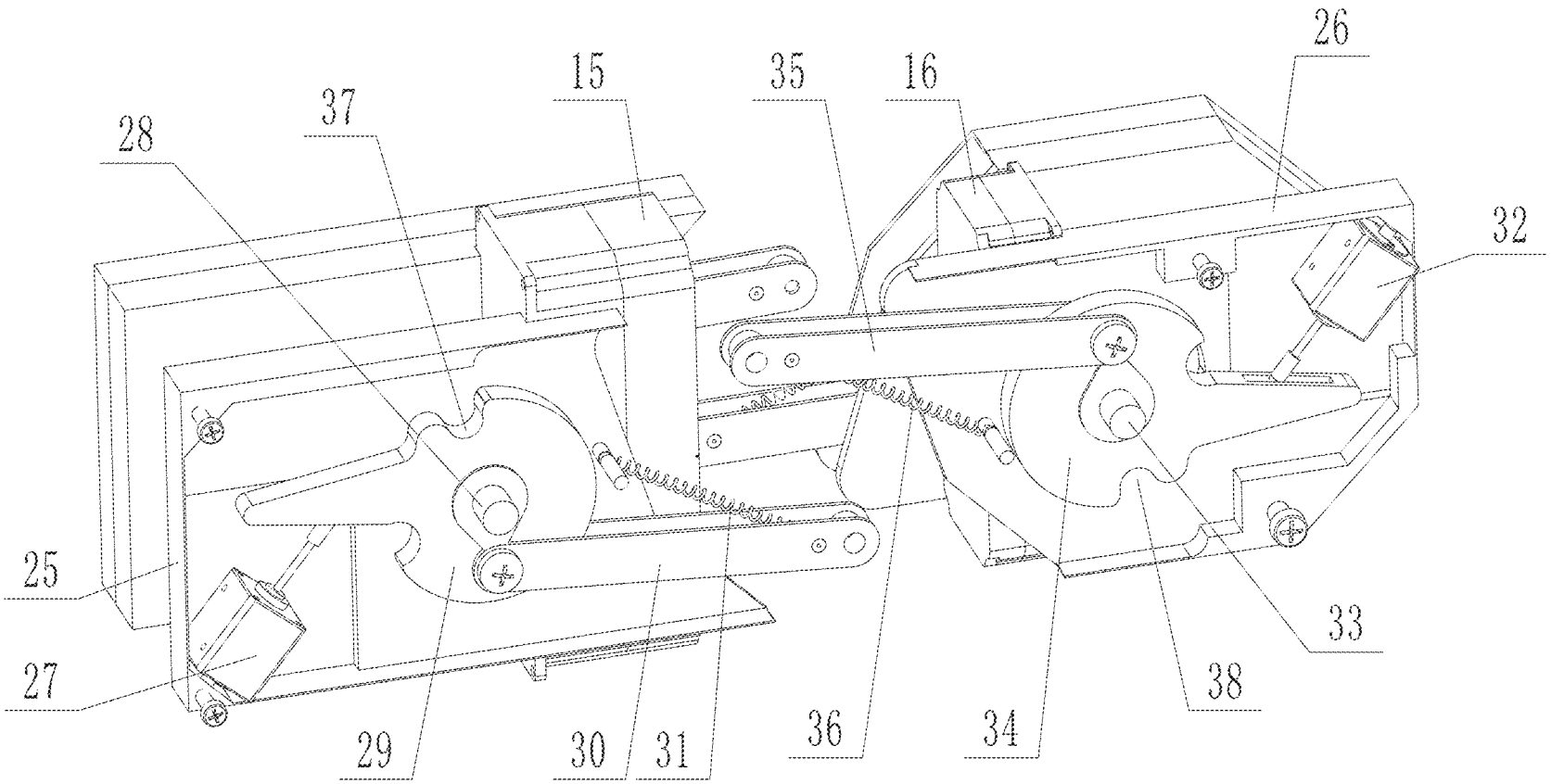
FIG. 7 is a structural schematic diagram when the coupling mechanism is disengaged in a specific embodiment of this invention.
Figure 8:
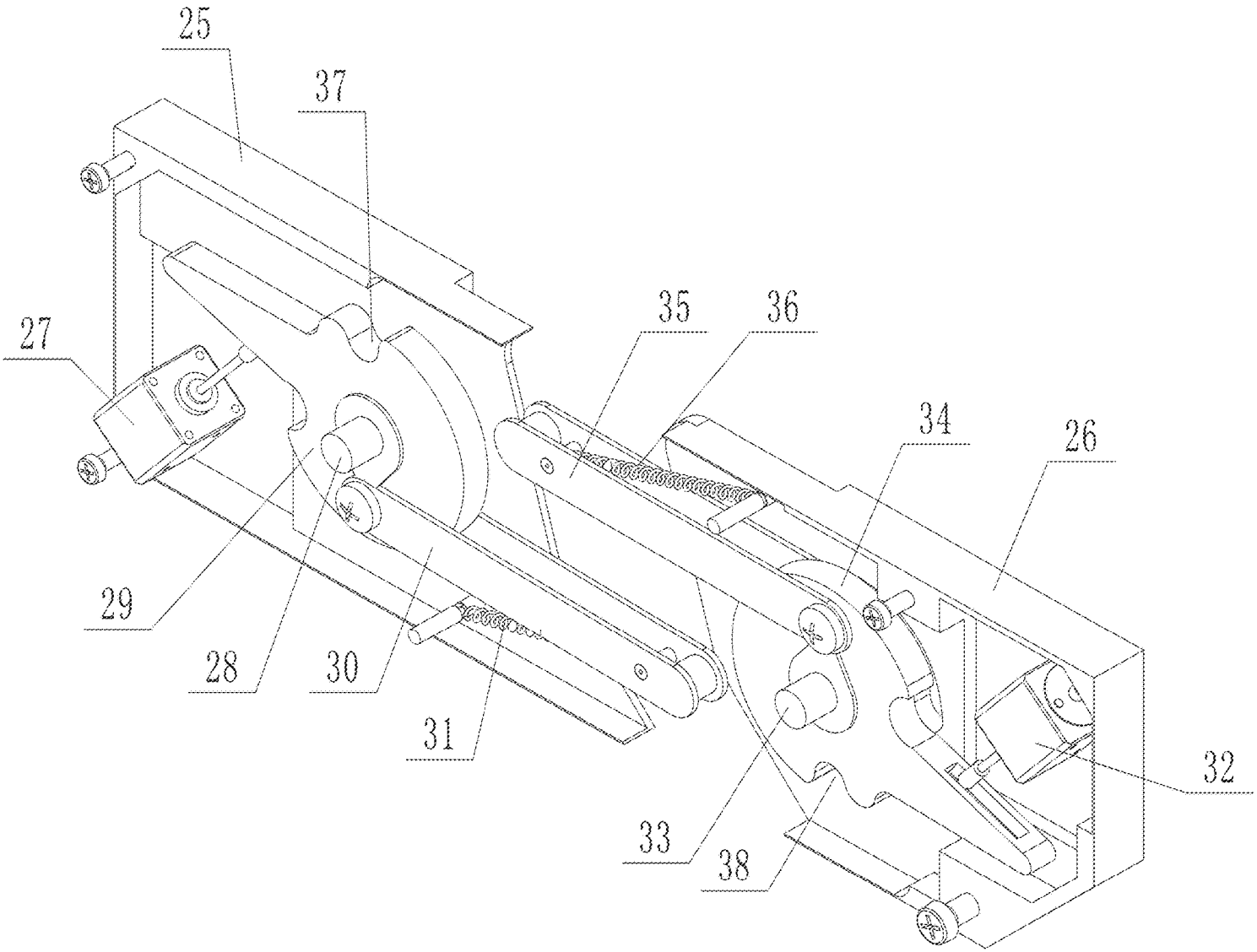
FIG. 8 is a structural schematic diagram when the coupling mechanism is disengaged in a specific embodiment of this invention.
Figure 9:
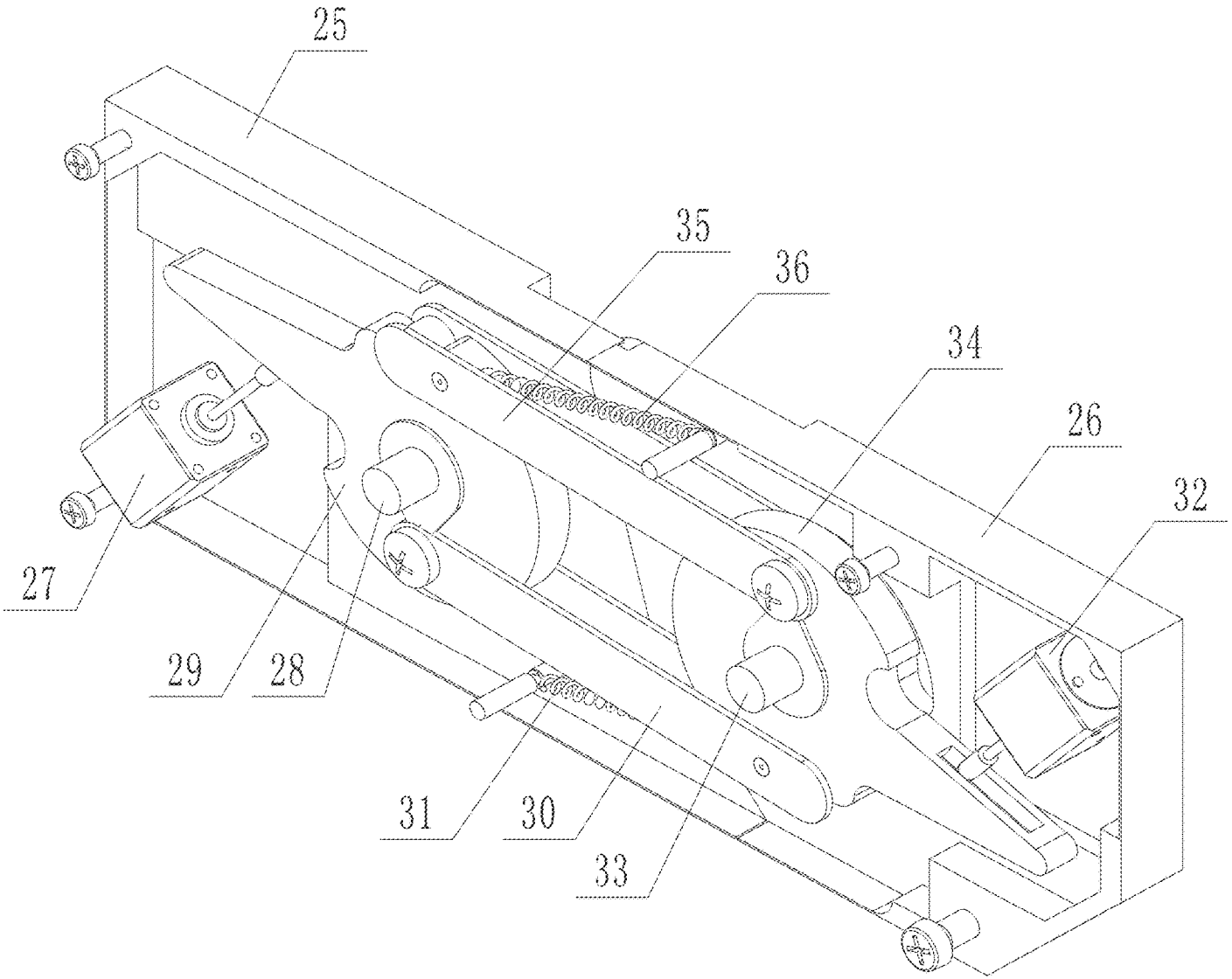
FIG. 9 is a structural schematic diagram when the coupling mechanism is docked in a specific embodiment of this invention.

It should be noted that FIGS. 8 and 9 show a schematic diagram of one set of matching first mounting plate 25 and second mounting plate 26. Of course, a structure with two sets of matching first mounting plate 25 and second mounting plate 26 as shown in FIG. 7 can also be used, or more sets of matching first mounting plate 25 and second mounting plate 26 can be used in other embodiments.

In the state shown in FIG. 7, the wireless charging transmitter module 15 is located between the two first mounting plates 25, and the wireless charging receiver module 16 is located between the two second mounting plates 26.

In a more preferred embodiment, as shown in FIGS. 7 to 9, both the first engaging member 30 and the second engaging member 35 include two opposing connecting rods, with one end of the two rods simultaneously hinged on the corresponding first positioning wheel 29 or second positioning wheel 34, and the other end of the two rods connected by a columnar body, which matches the corresponding first engaging slot 37 or second engaging slot 38; moreover, the spacing between the two connecting rods is greater than or equal to the thickness of the first positioning wheel 29 and the second positioning wheel 34.

In a more preferred embodiment, there is a gap between the first positioning wheel 29 and the first mounting plate 25, and a gap between the second positioning wheel 34 and the second mounting plate 26.

In a more preferred embodiment, when the coupling mechanism is docked, the first elastic member 31 is used to make the first engaging member 30 firmly abut against the inside of the second engaging slot 38, and the second elastic member 36 is used to make the second engaging member 35 firmly abut against the inside of the first engaging slot 37, preventing the coupling mechanism from automatically disengaging.

In a more preferred embodiment, both the fifth power source 27 and the sixth power source 32 use linear actuators such as electric push rods to achieve their function. The linear actuators are installed on their respective mounting plates, with their output ends hinged to the corresponding positioning wheels.

In a more preferred embodiment, when docking the coupling mechanism, the third sensor can sense the distance and posture of the second engaging member 35 using laser radar or ultrasound.

The specific embodiments described above provide further detailed explanations of the purpose, technical solution, and beneficial effects of this invention. It should be understood that the above descriptions are only specific embodiments of this invention and are not intended to limit the scope of protection of this invention. Any modifications, equivalent replacements, improvements, etc., made within the spirit and principles of this invention should be included within the scope of protection of this invention.

It should be noted that in this document, relational terms such as "first" and "second" are only used to distinguish one entity or operation from another entity or operation, and do not necessarily require or imply any actual relationship or order between these entities or operations. Moreover, the terms "include," "contain" or any other variants thereof are intended to cover non-exclusive inclusion, so that a process, method, article, or device that includes a series of elements not only includes those elements but also includes other elements not explicitly listed, or also includes elements inherent to such process, method, article, or device. Furthermore, the term "connected" used in this document, unless otherwise specified, can mean directly connected or indirectly connected through other components.

What is claimed is:

1. An intelligent water detection tool for horizontal wells, comprising a water detection instrument, characterized in that said intelligent water detection tool for horizontal wells further comprises a floating-diving component for driving the movement of said water detection instrument, a buoyancy device connected to said water detection instrument, and a buoyancy adjustment component for adjusting the water displacement volume of said buoyancy device, and further comprising:

an anchoring sub that is coaxial with and detachably connected to a shell of said intelligent water detection tool, said anchoring sub having a cable connection head;

a first docking part set on said anchoring sub and a second docking part connected to said shell;

a coupling mechanism for engaging and disengaging the first docking part and the second docking part, wherein said coupling mechanism comprises:

a first mounting plate located inside the first docking part, a fifth power source fixedly installed on the first mounting plate, a first positioning wheel rotatably connected to the first mounting plate through a first shaft, a first engaging member hinged on the first positioning wheel, a first engaging slot opened on an outer diameter end of the first positioning wheel, and a first elastic member connected between the first engaging member and the first mounting plate, wherein the fifth power source drives the first positioning wheel to rotate around the first shaft; and a second mounting plate located inside the second docking part, a sixth power source fixedly installed on the second mounting plate, a second positioning wheel rotatably connected to the second mounting plate through a second shaft, a second engaging member hinged on the second positioning wheel, a second engaging slot opened on an outer diameter end of the second positioning wheel, and a second elastic member connected between the second engaging member and the second mounting plate, wherein the sixth power source drives the second positioning wheel to rotate around the second shaft;

wherein when the first docking part and the second docking part are in a mutually docked state, the first engaging member is engaged in the second engaging slot and the second engaging member is engaged in the first engaging slot, with the first engaging slot and the second engaging slot located on opposite sides of a line connecting the first shaft and the second shaft; and wherein when the first docking part and the second docking part are to be separated, the fifth power source and the sixth power source are activated to rotate the first positioning wheel and the second positioning wheel, causing the first engaging member to disengage from the second engaging slot and the second engaging member to disengage from the first engaging slot;

an orientation mechanism for rotating said first docking part; and a third sensor set on either the first docking part or the second docking part, wherein said third sensor is used to obtain the distance and/or posture of the second docking part or the first docking part when the first docking part and the second docking part are docking.

2. The intelligent water detection tool for horizontal wells according to claim 1, characterized in that said floating-diving component comprises propeller blades located inside the shell, a first power source for driving the rotation of said propeller blades, and the area where said propeller blades are located is connected to the outside of the shell.

3. The intelligent water detection tool for horizontal wells according to claim 2, characterized in that said buoyancy device comprises a bag located inside said shell, the area where said bag is located is connected to the outside of the shell, and the bag is filled with hydraulic oil.

4. The intelligent water detection tool for horizontal wells according to claim 3, characterized in that said buoyancy adjustment component comprises an oil cylinder connected to said bag, a piston located inside said oil cylinder, and a second power source for driving said piston to move within the oil cylinder.

5. The intelligent water detection tool for horizontal wells according to claim 4, characterized in that said buoyancy adjustment component further comprises a sensing ring installed on the surface of the shell, multiple first sensors evenly distributed on said sensing ring, and a control module signal-connected to said first sensors; said first sensors are used to sense the wall of said horizontal wells, and said control module is used to control the second power source.

6. The intelligent water detection tool for horizontal wells according to claim 5, characterized in that said intelligent water detection tool for horizontal wells further comprises a second sensor for sensing the circumferential posture of said intelligent water detection tool for horizontal wells, said second sensor is signal-connected to said control module.

7. The intelligent water detection tool for horizontal wells according to claim 1, characterized in that said intelligent water detection tool for horizontal wells further comprises a battery set inside said shell, a wireless charging transmitter module set on the first docking part, and a wireless charging receiver module set on the second docking part; said wireless charging receiver module is electrically connected to said battery; when the first docking part and the second docking part are docked, said wireless charging transmitter module and wireless charging receiver module are electrically connected.

* * * * *